US005370563A

United States Patent [19]

Yamazaki et al.

[11] Patent Number: 5,370,563

[45] Date of Patent: Dec. 6, 1994

[54] MARINE PROPULSION ENGINE

[75] Inventors: Akinori Yamazaki; Manabu Nakayama; Koji Abe, all of Iwata, Japan

[73] Assignee: Sanshin Kogyo Kabushiki Kaisha, Hamamatsu, Japan

[21] Appl. No.: 91,606

[22] Filed: Jul. 13, 1993

[30] Foreign Application Priority Data

Jul. 13, 1992 [JP] Japan ..... 4-208473

[51] Int. Cl.[5] ..... B63H 21/24

[52] U.S. Cl. ..... 440/77; 440/88; 440/900

[58] Field of Search ..... 440/53, 63, 75-78, 440/88, 84, 85, 900; 123/195 P; 181/214, 229

[56] References Cited

U.S. PATENT DOCUMENTS 3,217,696 11/1965 Kiekhaefer ..... 440/900
3,310,021 3/1967 Shimankas ..... 440/900
4,734,070 3/1988 Mendek ..... 123/195 P
4,978,321 12/1990 Ferguson ..... 440/88
5,052,960 10/1991 Kato ..... 440/77
5,078,101 1/1992 Anderson et al. ..... 440/85

FOREIGN PATENT DOCUMENTS 3-157295 2/1990 Japan .
2-141392 3/1991 Japan .

*Primary Examiner*—Edwin L. Swinehart
*Attorney, Agent, or Firm*—Knobbe, Martens, Olson & Bear

[57] ABSTRACT

Embodiments of outboard motors having separate electrical generators driven by the engine output shaft from the magneto generator. The protective cowling and engine induction system is configured so that air flowing to the induction system will not flow across the electrical power generator and thus the generator is protected from corrosion as might be caused by the water contained in the air inducted to the engine.

9 Claims, 4 Drawing Sheets

MARINE PROPULSION ENGINE

BACKGROUND OF THE INVENTION

This invention relates to a marine propulsion engine and more particularly to an improved arrangement for locating an electrical generator in a marine outboard drive.

As is well known, one common form of marine propulsion unit is an outboard motor. Outboard motors are extremely compact power sources and include a powerhead that contains an internal combustion engine which drives a propulsion device for propelling the watercraft. Conventionally, a protective cowling is provided around the engine so as to improve the appearance, reduce noise transmission and otherwise provide a neater and more serviceable unit.

It has been the practice to provide a magneto generator driven from the crankshaft of the engine so as to provide not only the power for firing the spark plugs but also auxiliary electrical power for various accessories both for the engine and also for the associated watercraft. Conventionally outboard motors have the engines positioned so that the output shaft rotates about a vertically extending axis and the magneto generator is positioned at the top of the engine. However, with increasing demands on the electrical generating capacity, it has been proposed to employ a separate generator for generating electrical power. This may be required to operate other components of the engine such as solenoids and the like for fuel and/or fuel/air injectors, for driving other engine accessories that require electrical power and for providing electrical power for the associated watercraft.

As is well known, such outboard motors operate in an atmosphere where there is a large amount of water vapor present. It is also necessary to draw atmospheric air into the protective cowling for induction into the engine for its combustion operation. Although the air induction system normally includes devices which are intended to separate, as much as possible, the water from the air inducted, nevertheless there is a high amount of water vapor present in the air that is inducted.

This induction air flows through the interior of the protective cowling and even though shielding is employed for the electrical generator, a large amount of moisture ladened water can come in contact with the generator with conventional constructions. This provides obvious disadvantages.

It is, therefore, a principal object of this invention to provide an improved powerhead construction for an outboard motor wherein the electrical generator will not be subject to large amounts of water ladened air.

It is a further object of this invention to provide an improved component layout and induction system for the powerhead of an outboard motor so as to protect the electrical generating apparatus from the intrusion of large amounts of water.

It is a further object of this invention to provide a layout for the powerhead of an outboard motor wherein the induction air is routed away from the electrical generator.

SUMMARY OF THE INVENTION

This invention is adapted to be embodied in a powerhead for an outboard motor that is comprised of an internal combustion engine having an induction system.

A protective cowling surrounds and encloses the engine and has an atmospheric air inlet opening through which atmospheric air may be drawn into the interior of the cowling. The engine induction system, protective cowling and atmospheric air inlet opening define an air flow path from the air inlet opening to the induction system. In accordance with the invention, an electrical power generator is driven by the engine and is positioned within the cowling and out of the air flow path.

DETAILED DESCRIPTION OF THE PREFERRED EMBODIMENTS OF THE INVENTION

Figure 1:
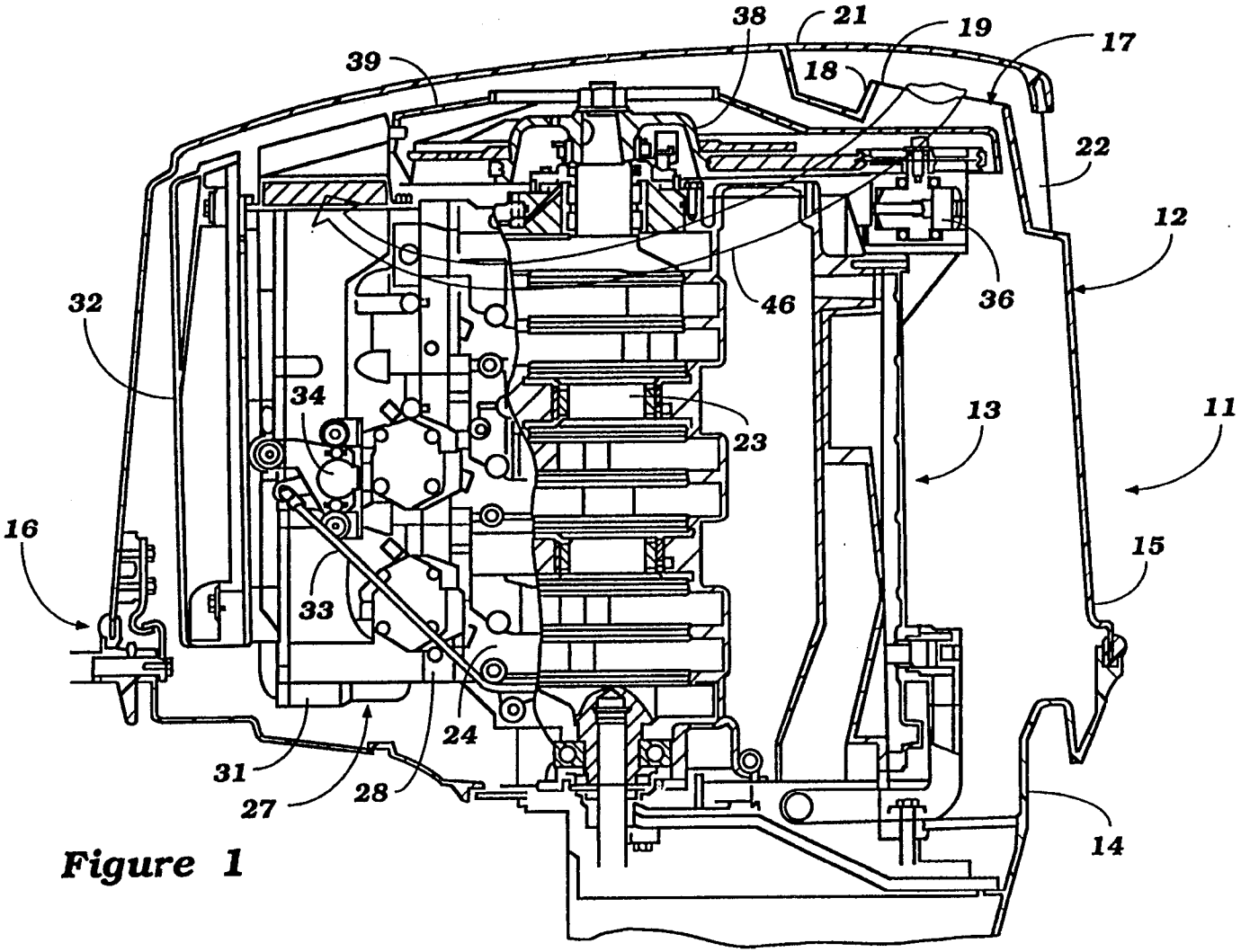
FIG. 1 is a side elevational view with portions broken away and other portions shown in section of an outboard motor constructed in accordance with a first embodiment of the invention.
Figure 2:
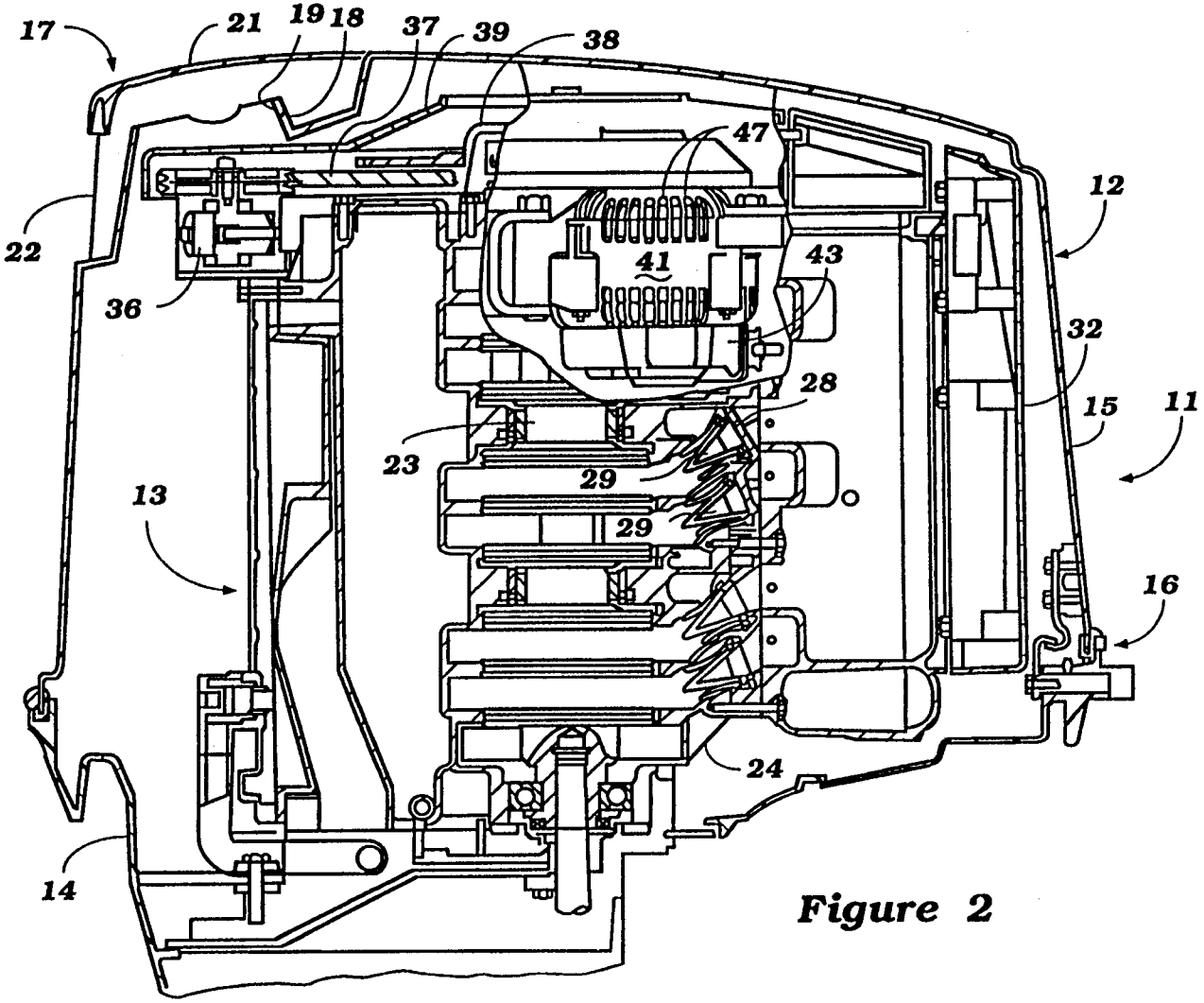
FIG. 2 is a cross sectional view, in part similar to FIG. 1, but looking at the opposite side and with other portions broken away.
Figure 3:
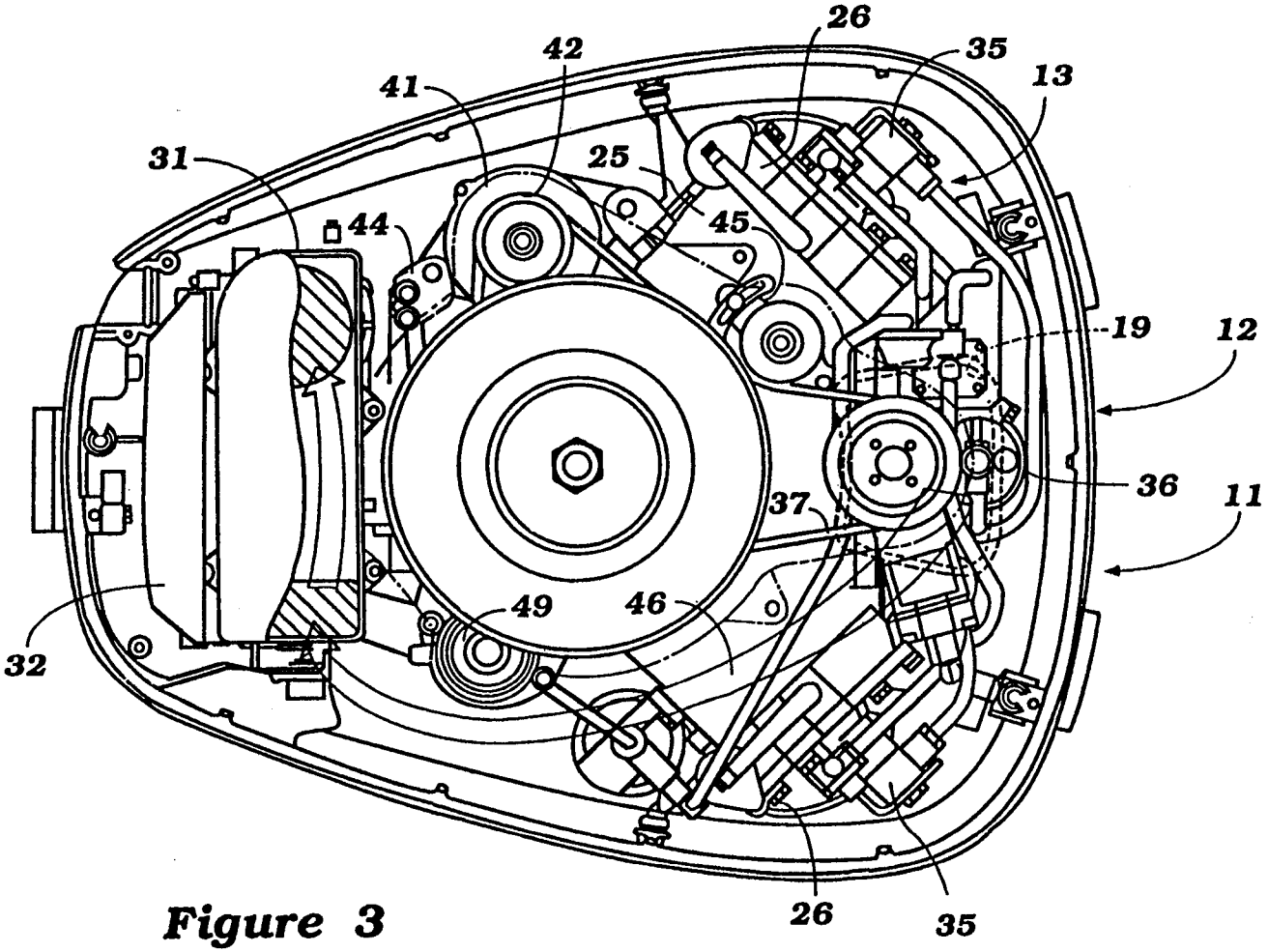
FIG. 3 is a top plan view of the powerhead with the cover of the protective cowling so as to show the location of the components.

Referring now in detail to the drawings and first to the embodiment of FIGS. 1 through 3, an outboard motor constructed in accordance with this embodiment is shown partially and is identified generally by the reference numeral 11. The outboard motor 11 is shown only partially because the invention deals primarily with the powerhead, indicated generally by the reference numeral 12 and for that reason the other components, consisting of the drive shaft housing and lower unit are not illustrated nor will they be described. It should be readily apparent to those skilled in the art how the invention can be employed in conjunction with outboard motors.

The powerhead 12 is comprised of a powering internal combustion engine indicated generally by the reference numeral 13 and in this embodiment the engine 13 is comprised of a V-6, two-cycle, crankcase compression engine. As will become apparent by description of the remaining embodiment, the invention is not limited to the number of cylinders employed or the cylinder orientation. In addition, the invention is not limited to reciprocating engines or engines operating only on the two stroke crankcase chamber principal. However, since such two stroke crankcase compression engines are particularly common in outboard motors this type of embodiment is depicted.

In addition to the engine 13, the powerhead 12 is comprised of a protective cowling arrangement that includes a lower tray portion 14 which may be formed from a rigid material such as aluminum or a molded fiberglass reinforced resin and which is affixed in a suitable manner to the upper end of the drive shaft housing. A main cowling portion 15 which has a generally inverted cup shape and which is formed from a molded fiberglass reinforced resin is detachably connected to the tray 14 by means including a latch assembly, indicated generally by the reference numeral 16 so as to facilitate ready removal of the main cowling portion 15 for servicing of the engine 13.

The cowling assembly as thus far described defines an internal cavity in which the engine 13 is positioned with air spaces around the engine 13, for reasons which will become apparent.

As should be readily apparent, it is desirable to provide a relatively air tight seal around the engine 13. However, atmospheric air must be admitted to the interior of the protective cowling for engine operation. An air inlet system, indicated generally by the reference numeral 17 is provided the main cowling portion 15 at the rear end thereof. This includes an upwardly extending neck 18 defining an atmospheric air inlet opening 19 through which atmospheric air may flow to the interior of the protective cowling. A protective cover piece 21 is affixed in a suitable manner to the main cowling portion 15 and extends across and protects the air inlet opening 19. A rearwardly facing inlet 22 is defined between the cover piece 21 and the main cowling portion 15 so that atmospheric air may be drawn into the air inlet opening for delivery to the engine in a manner which will be described.

As is typical with outboard motor practice, the engine 13 is supported within the powerhead 12 so that its output shaft, a crankshaft 23 is supported for rotation about a vertically extending axis. The crankshaft 23 rotates in crankcase chambers formed by a crankcase member 24 and a cylinder block assembly 25. Since in the illustrated embodiment, the engine 13 is of the V-6 type, the cylinder block assembly 25 is provided with a pair of angularly disposed cylinder banks each containing three cylinders with cylinder head assembly 26 being affixed to each cylinder bank and closing the respective cylinder bores thereof. Since the invention deals primarily with the layout of certain components for the engine, the internal details of the engine are not believed to be necessary to permit those skilled in the art to understand and practice the invention and thus further description of the engine except for its auxiliaries will not be made.

An air charge is delivered to the crankcase chambers of the engine through an induction system, which is indicated generally by the reference numeral 27 and which is comprised of an intake manifold 28 and a plurality of reed valve assemblies 29 that permit flow into the individual crankcase chambers of the engine while precluding reverse flow. An air intake device, indicated generally by the reference numeral 31 is affixed to the intake manifold 28 and has an atmospheric air inlet at one side thereof which is oriented for a purpose which will be described. A baffle plate 32 is affixed to the outside of the air inlet device so as to provide a closure and some sound deadening therefor.

The intake manifold 28 or the air inlet device 31 is provided with a plurality of throttle valves which are operated by a throttle control link 33 from a remote operator. A throttle valve position detector 34 is provided so as to give a signal indicative of the position of the throttle valve for engine control.

In the illustrated embodiment, the engine is provided with a system whereby fuel and high pressure air is injected directly into the combustion chambers of the engine by means of fuel/air injectors 35 that are mounted in the cylinder head assemblies 26 and which may be of any known type of construction. A high pressure fuel injection pump 36 is driven off of the upper end of the crankshaft 23 by means of a drive belt 37 and delivers the high pressure fuel to the fuel/air injectors 35. A suitable fuel pressure regulator is provided in this system so as to control the pressure at which the fuel is supplied.

A flywheel magneto assembly, indicated generally by the reference numeral 38 is also driven off of the upper end of the crankshaft 23 in a known manner and provides the electrical power for firing the spark plugs of the engine in a well known manner. A cover plate 39 is affixed to the top of the engine and overlies not only the flywheel magneto 38 but also the fuel pump 36 and the drive belt 37 therefor although this cover plate is removed in FIG. 3 to more clearly show the construction.

In addition to the electrical power supplied by the flywheel magneto 38, there is provided an electric generator or alternator 41 which has a pulley 42 that is also driven by the drive belt 37. The generator or alternator 41 is disposed on one side of the crankshaft and on the side of the air inlet device 31 opposite its air inlet opening. The reason for this will be described later.

The generator or alternator 41 is also positioned beneath the cover plate 39 and hence will be protected by it. An air pump 43 is formed integrally with the lower side of the generator or alternator 41 and supplies high pressure air to the fuel/air injectors 35 with a suitable regulating system so as to maintain the desired air pressure.

The alternator generator 41 is mounted on a mounting bracket 44 and its angular position may be adjusted so as to permit removal of the drive belt 37 and tensioning of it. In addition, an idler tensioner 45 is also mounted on the engine and operates to maintain the tension in the drive belt 37.

It should be noted that the air inlet opening 19 of the cowling piece 15 is disposed at the end of the engine opposite the air inlet device 31 and the path of air flow from the inlet opening 19 to the air inlet device 31 and specifically its side positioned opening is shown by the arrow 46 in FIGS. 1 and It should be noted that this air flow 46 is on the opposite side of the engine from the alternator generator 41 and, accordingly, any water vapor that is drawn in with the intake air will not flow over the alternator generator 41 and cause corrosion of Because of the heat generated by the operation of the alternator generator it is desirable to provide air flow openings 47 in its outer housing and an internal fan that circulates air for cooling purposes. However and as noted above, however, this is away from the air flowing to the air inlet device and hence corrosion problems will be substantially reduced.

The engine is provided also with an electrical starter, indicated generally by the reference numeral 49 which cooperates with teeth on the flywheel magneto 38 for starting of the engine in a known manner.

Figure 4:
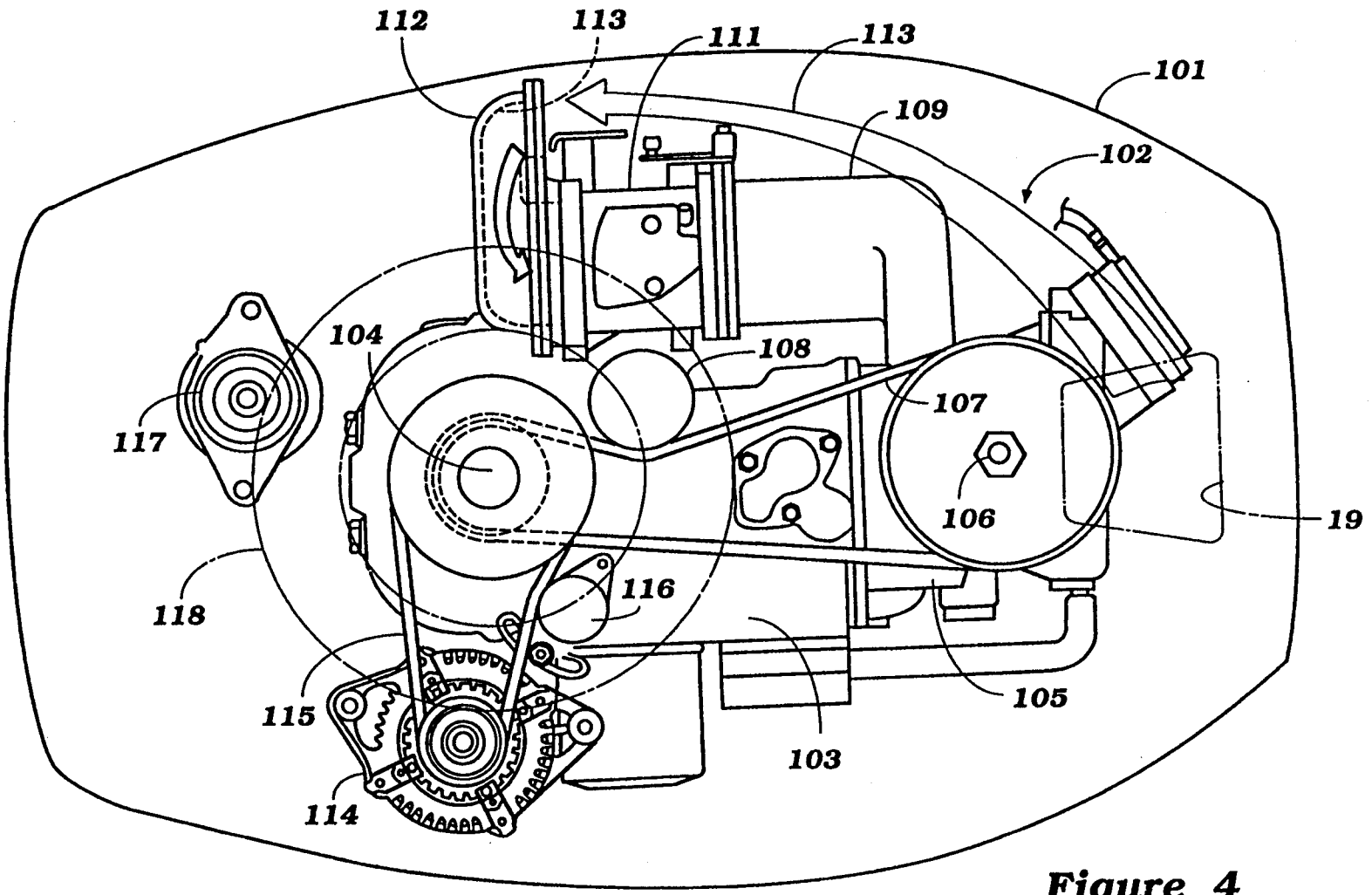
FIG. 4 is a top plan view, in part similar to FIG. 3, and shows another embodiment of the invention.

FIG. 4 is another embodiment of the invention and shows the application of the invention to an in-line type of engine. This embodiment is depicted only in a top view and the protective cowling of the powerhead is shown generally by the line 101 and may have a configuration of the type previously described including the upwardly opening air inlet opening 19 at one end thereof. This embodiment depicts a four-cycle engine rather than a two-cycle engine and also an engine having aligned cylinders. The engine is identified generally by the reference numeral 102 and includes a cylinder block 103 in which one or more cylinders are disposed. A crankshaft 104 is rotatably journaled at the lower end of the cylinder block within a crankcase chamber.

A cylinder head assembly 105 is affixed to the cylinder block 103 and closes its respective cylinder bores. In this embodiment, the engine has a single overhead cam and an overhead camshaft 106 is mounted in the cylinder head 105 and is driven by a tooth belt 107 from the crankshaft 104 in a well known manner. An idler tensioner pulley 108 is provided for maintaining the desired tension on the timing belt 107.

An intake manifold 109 is provided on one side of the cylinder head 105 and cooperates with a throttle body 111 in which a throttle valve is positioned which is operated by a suitable throttle mechanism. An air inlet device 112 is mounted at the same side of the engine and has a rearwardly facing air inlet opening 113 which receives air flowing from the cowling inlet opening 19 in a path as shown by the arrow 113.

An alternator 114 or generator is disposed on the opposite side of the engine and is driven from the crankshaft 104 by a drive belt 115. An idler tensioner pulley 116 tensions the drive belt 115. Thus, like the previously described embodiment this embodiment places the alternator generator 114 on the side of the engine opposite to where the air flow for the induction system is and hence the generator or alternator 114 will be protected from water and corrosion.

An electrical starter 117 is mounted at one end of the engine and cooperates with the flywheel magneto 118 of this embodiment for electric starting.

It should be readily apparent from the foregoing description that the described embodiments of the invention provide a very compact arrangement for the powerhead of an outboard motor and which permits the use of an electrical generator independently of the flywheel magneto but nevertheless places this generator out of the air flow path for the induction system so as protect it from water vapor and corrosion. Of course, the foregoing description is that of preferred embodiments of the invention and various changes and modifications may be made without departing from the spirit and scope of the invention, as defined by the appended claims.

We claim:

1. A powerhead for an outboard motor comprising an internal combustion engine having an induction system having an air inlet, a protective cowling surrounding and enclosing said engine, an atmospheric air inlet opening in said protective cowling through which atmospheric air may be drawn to the interior of said cowling, said engine, said induction system air inlet, said protective cowling and said atmospheric air inlet opening defining an air flow path from said air inlet opening to said induction system air inlet, and an electrical power generator driven by said engine and positioned within said cowling remotely from said air flow path so that atmospheric air flowing to said induction system air inlet does not pass across said electrical power generator.

2. A powerhead for an outboard motor as set forth in claim 1 wherein the electrical power generator is driven from the engine output shaft.

3. A powerhead for an outboard motor as set forth in claim 2 wherein the engine output shaft rotates about a vertically disposed axis.

4. A powerhead for an outboard motor as set forth in claim 3 wherein the electrical power generator is disposed on one side of the engine.

5. A powerhead for an outboard motor as set forth in claim 4 wherein the air flow path is disposed on the opposite side of the engine from the electrical power generator.

6. A powerhead for an outboard motor as set forth in claim 3 wherein the air inlet opening is formed at the top of the engine.

7. A powerhead for an outboard motor as set forth in claim 6 further including a protective cover positioned within the protective cowling and extending across the top of the engine, the engine output shaft and the electrical power generator.

8. A powerhead for an outboard motor as set forth in claim 7 wherein the electrical power generator is disposed on one side of the engine.

9. A powerhead for an outboard motor as set forth in claim 8 wherein the air flow path is disposed on the opposite side of the engine from the electrical power generator.

* * * * *